US005996575A

United States Patent [19]

Shimek et al.

[11] Patent Number: 5,996,575

[45] Date of Patent: Dec. 7, 1999

[54] LOW COST PREFABRICATED FIREPLACE WITH FIBER INSULATION FIREBOX

[75] Inventors: Ronald John Shimek, Prior Lake; Robb Edward Bennett, Jordan; David Charles Lyons, Redwing; Daniel Curtis Shimek, Apple Valley; Timothy Wayne Johnson, Jordan, all of Minn.

[73] Assignee: Heat-N-Glo Fireplace Products, Inc., Savage, Minn.

[21] Appl. No.: 09/024,285

[22] Filed: Feb. 17, 1998

[51] Int. Cl.[6] ..... F23C 1/18; F24C 3/00

[52] U.S. Cl. ..... 126/512; 126/500; 126/521; 126/86; 431/126

[58] Field of Search ..... 126/512, 500, 126/144, 8, 86, 92 B, 85 B, 521, 145, 520; 431/125, 126

[56] References Cited

U.S. PATENT DOCUMENTS

| | | | |
|---|---|---|---|
| 2,821,975 | 2/1958 | Thulman | 126/500 |
| 3,100,734 | 8/1963 | Rex, Jr. et al. | 162/152 |
| 3,301,249 | 1/1967 | Hendricks | 126/500 |
| 3,935,060 | 1/1976 | Blome et al. | 162/152 |
| 4,041,929 | 8/1977 | Cooksey | 126/144 |
| 4,945,692 | 8/1990 | Gallier | 52/36.3 |
| 4,971,030 | 11/1990 | Thow et al. | 126/512 |
| 5,155,959 | 10/1992 | Richards et al. | 52/455 |
| 5,186,161 | 2/1993 | Shumock | 126/500 |
| 5,647,340 | 7/1997 | Shimek et al. | 126/512 |
| 5,647,341 | 7/1997 | Langman et al. | 126/512 |
| 5,915,374 | 6/1999 | Susany | 126/512 |

*Primary Examiner*—Ira S. Lazarus
*Assistant Examiner*—Josiah Cocks
*Attorney, Agent, or Firm*—John B. Sowell-ATY

[57] ABSTRACT

A low cost prefabricated fireplace is provided with an open-ended fireplace box which requires no outer sheet metal shroud or housing as employed in the prior art sheet metal fireplaces. The novel fireplace box has at least five walls which consist substantially of insulating reinforced ceramic fiber (RCF) material and a binder. A modular burner system is removably mounted on the bottom wall of the fireplace box and a floor panel is mounted on the modular burner system forming an air chamber below the floor panel in the fireplace box. A decorative surround trim is attached to the open end of the fireplace box which serves to support fixed or operable glass doors. A log set which may include a log burner is mounted above the floor panel which supports a decorative log set. Apertures are made in the sides or top of the fireplace box to accommodate an air supply and/or an exhaust stack. The fireplace box serves as a base unit to which other fireplace components are attached, connected or supported so that the need for conventional sheet metal is substantially eliminated. The resulting fireplace can be completed in many different configurations using a common fireplace box which needs no additional surrounding insulation for installation in a room.

19 Claims, 11 Drawing Sheets

LOW COST PREFABRICATED FIREPLACE WITH FIBER INSULATION FIREBOX

RELATED APPLICATIONS

This application relates to our co-pending U.S. application Ser. No. 08/588,866 filed Jan. 19, 1996 for a Universal Non-Porous Fiber Reinforced Combustion Chamber which is incorporated by reference herein.

BACKGROUND OF THE INVENTION

1. Field of the Invention

The present invention relates to prefabricated fireplaces in general. More specifically, the present invention relates to low cost fireplaces that comprise an open-ended fiber insulation firebox and combustion chamber formed or molded in one piece from a slurry of refractory ceramic fibers.

2. Description of the Prior Art

It was known heretofore that flat panels of lightweight, low coefficient of heat transfer ceramic material could be made. Heat-N-Glow of Savage Minnesota has produced and incorporated thin panels of such insulating ceramic material into floors of their prefabricated fireplaces that are made of sheet metal.

In our co-pending application U.S. Ser .No. 08/588,866 there is shown and described an open-ended non-porous ceramic combustion chamber which may be assembled from panels in the field or made by forming a one piece open box on forming molds. Both type open boxes may be assembled into a fireplace by adding a burner and a log set, etc. The burner system illustrated employs the floor of the firebox as the floor of the combustion chamber. The referenced application also shows and describes how standard fireplace boxes may be assembled into different fireplace units by connecting a burner system to the open box and connecting different exhaust stacks and air supplies to the standard open box.

The present application shows and describes improvements in this co-pending application which may be universally applied to all types of fireplace configurations, thus, the present invention when applied to prefabricated fireplaces substantially reduces the manufacturing cost of the most expensive fireplaces and for the first time provides the technology to produce very low cost decorative gas fireplaces for custom installation and for stand alone unvented units.

Applicants are not aware of any prefabricated fireplace units which do not require an outer housing or separate outer insulation around the outside of the combustion chamber or firebox.

It would be desirable to provide a novel fireplace units that virtually eliminates sheet metal combustion chambers, outer sheet metal shrouds and expensive stamped sheet metal forms and also provide a low cost fireplace unit.

SUMMARY OF THE INVENTION

It is a primary object of the present invention to lower the cost of fireplace units while increasing the quality and appearance of the decorative fireplace.

It is a primary object of the present invention to provide a novel fireplace box base unit of molded ceramic fiber material to which may be attached all of the necessary components to complete a fireplace in a variety of different models.

It is a primary object of the present invention to provide means for increasing the amount of convection heat attainable from a fireplace which has an insulated combustion chamber.

It is a another primary object of the present invention to provide prefabricated fireplace units which have the actual appearance of masonry fireplaces.

It is a another primary object of the present invention to provide a prefabricated fireplace unit which eliminates the need for an outer sheet metal housing while lowering the cost of the inner fire box.

It is a general object of the present invention to provide gas log fireplace units having an insulated firebox with an inner surface which is indistinguishable from a custom made fireplace.

It is a another general object of the present invention to provide in a ceramic fire box ceramic base burners and ceramic log burners which glow and burn in a manner which is indistinguishable from burning wood and glowing logs.

According to these and other objects of the present invention there is provided a low cost one piece open-ended fire box having a predetermined molded interior surface that is identical to masonry fireplaces. The fireplace box is made of lightweight high temperature RFC material and a binder and formed as a rigid box to which components such as a exhaust stack, coaxial stacks, collinear stacks and pipes, burner systems, gas log systems and surround trim are mounted thereon or therein to provide a complete prefabricated fireplace ready for installation in a room. Heat exchangers and catalytic converter units may also be mounted in or on the novel fireplace box to increase the efficiency of the fireplace units.

DESCRIPTION OF THE PREFERRED EMBODIMENTS

Figure 1:
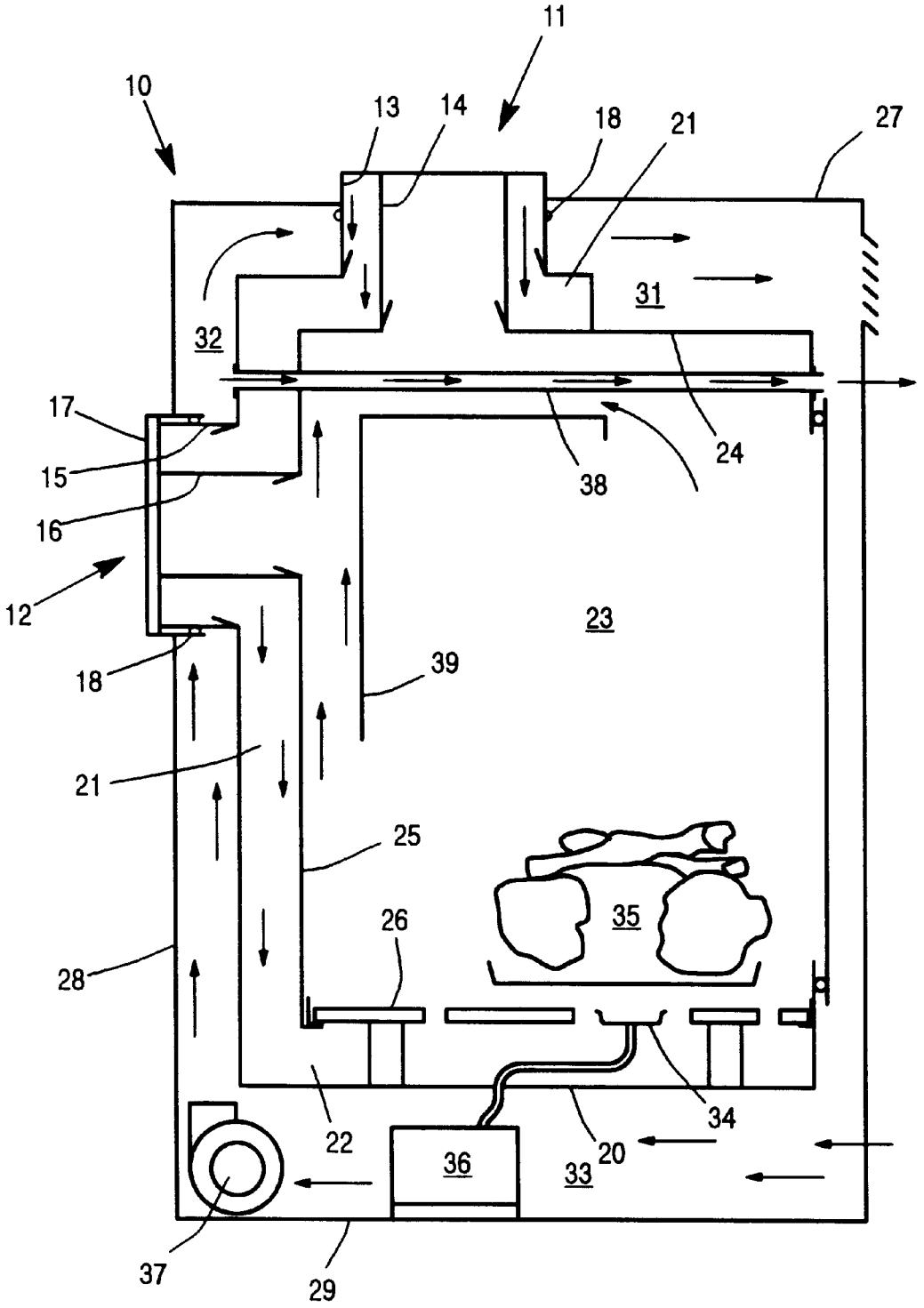
Figure 1 Prior Art
FIG. 1 is a schematic drawing in side elevation of a prior art direct vent fireplace unit having a metal combustion chamber surrounded by an outer housing prefabricated from formed panels of sheet metal.

Refer now to FIG. 1 showing a schematic drawing and side elevation of a convertible dual direct-vented fireplace of the type shown and described in our U.S. Pat. No. 5,647,340. The fireplace 10 is shown having a vertical venting means 11 and a horizontal venting means 12. For purposes of the descriptive terminology herein, the term venting means 11 or 12 refers to the fresh air vent 13 and the exhaust stack 14 which form a vertical venting means 11 or the elements 15, 16 which form the horizontal venting means 12. The preferred embodiment fireplace 10 is prefabricated from sheet metal and is further provided with means for sealing one of the two venting means 11 or 12. An economical seal is shown as a fabricated cap 17 having a twist lock or interrupted female screw feature which engages over raised interrupted male screw features on the fresh air vents 13 and 15 respectively. Conventional coupling means or twist lock interrupted screws means 18 may be used for sealing the stacks and vent pipes and is of a type known in the prior art. Other well known means could be employed to fix a cap 17 or plate over the venting means 11 or 12. A mat of resilient insulating material 19 is precut to seal both of the exhaust stacks 14 and vent pipe 13 which are preferably made as a coaxial pipe structure for reducing cost of manufacturing but could be made as a separate exhaust and vent pipes for reasons other than cost and efficiency.

In this prior art embodiment, a fresh combustion air plenum 21 is mounted on or connected onto the back wall of the combustion chamber and the top wall of the combustion chamber. Plenum 21 extends downward and connects to a fresh combustion air passageway 22 which preferably extends under panel 26 and/or connects directly into the combustion chamber 23. The combustion chamber 23 is provided with an outer panel 24, rear panel 25 and a lower or bottom panel 26. The surround of the enclosure of the fireplace is provided with an upper panel 27, a rear panel 28 and a lower panel 29 which surrounds the combustion chamber. The space between the panels form upper walls 31, back walls 32 and bottom walls 33 which provide heat exchanger passageways. A flat pan burner 34 is shown positioned below a log system 35 which may be supported on the floor 20 lower panel of the combustion chamber 26. The burner 34 is connected by a flexible pipe to a gas valve 36 which is located in the bottom wall 33. A blower system 37 is located in the bottom wall 33 which is part of a heat exchanger system formed by the walls 31, 32 and 33. An optional second heat exchanger system is formed by a plurality of tubes 38. There is further shown an adjustable baffle 39 which directs the exhaust gas around the back of the combustion chamber 23 to enhance the heat exchanger effect. It will be appreciated that all of the panels and ducts and pipes shown in the prior art FIG. 1 drawing are made of sheet metal with the sole exception of the logs set and the floor 26.

Figure 2:
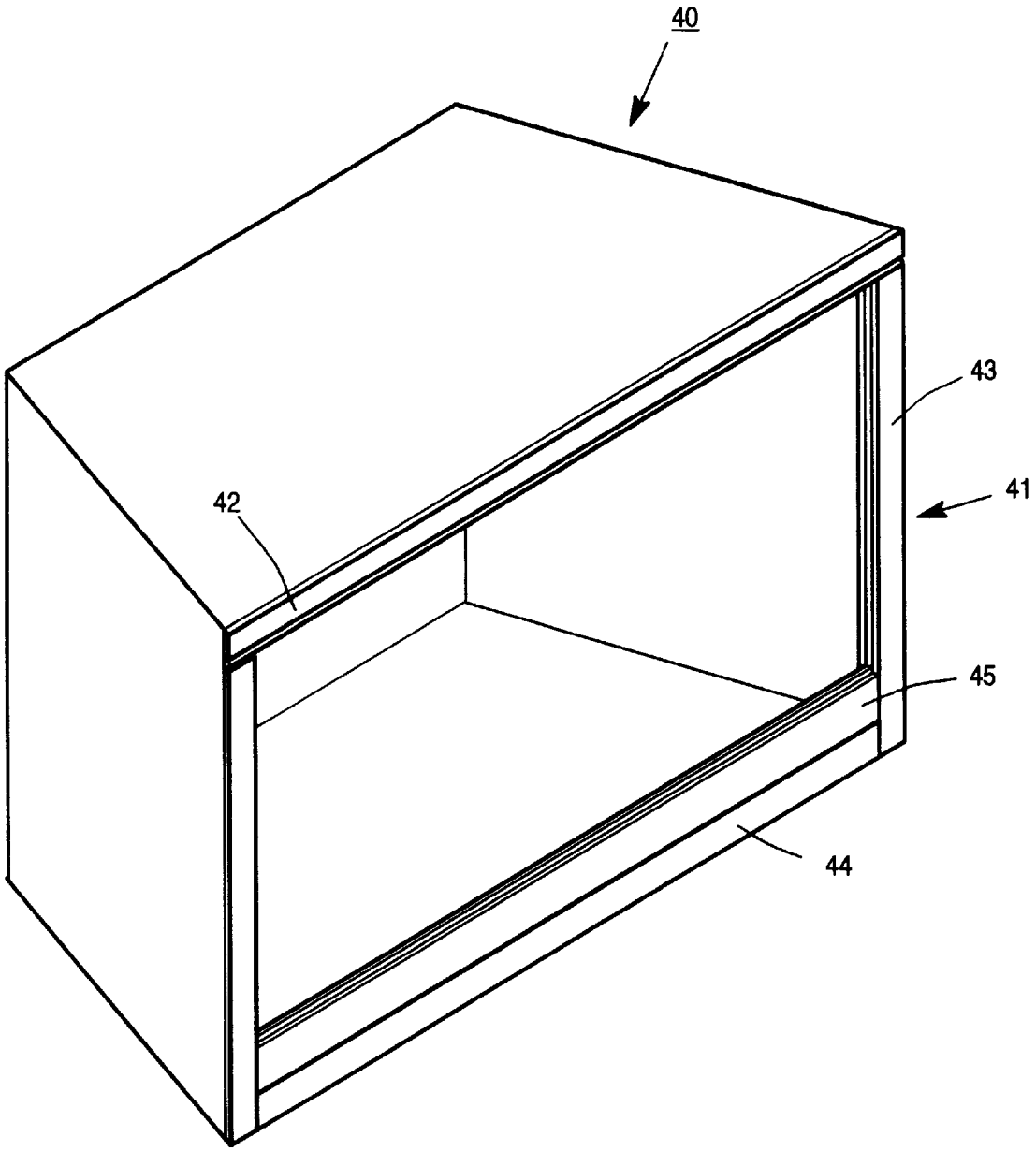
FIG. 2 is an isometric drawing of the present invention universal fireplace box made of molded RFC material showing a typical surround trim frame which attaches to the open end of the fire box.

Refer now to FIG. 2 showing an isometric drawing of the present invention universal fireplace box made of a molded reinforced fiber ceramic material (RFC) and showing in exploded view a typical surround trim frame which attaches to the open end of the ceramic fireplace box. The molded open-ended fire box 40 is shown having, in an exploded view, a frame 41 which mounts on the open end. Details of the frame are shown in enlarged details in which the top horizontal trim piece 42 attaches direct to the upper panel. A vertical trim piece similar to trim piece 42 attaches directly to the vertical edges of the side walls of the open ended fire box 40. In the preferred embodiment of the present invention, the trim piece for the bottom or lower panel is shown made in two pieces in which the lower channel 44 attaches direct to the face of the panel and a decorative extension pieces 42, 45 provides a door panel or a seal for a sealed glass front of the combustion chamber. In the embodiments to be explained hereinafter, when a plate of glass is sealed into the frame, the frame piece 41 is also sealed directly to the front of the fire box 40. However, when a operable door is attached to the frame 41 and pivoted on the upper and lower trim piece 45, the door itself has some leaks and the frame 41 need not be sealed and leak free.

Figure 3:
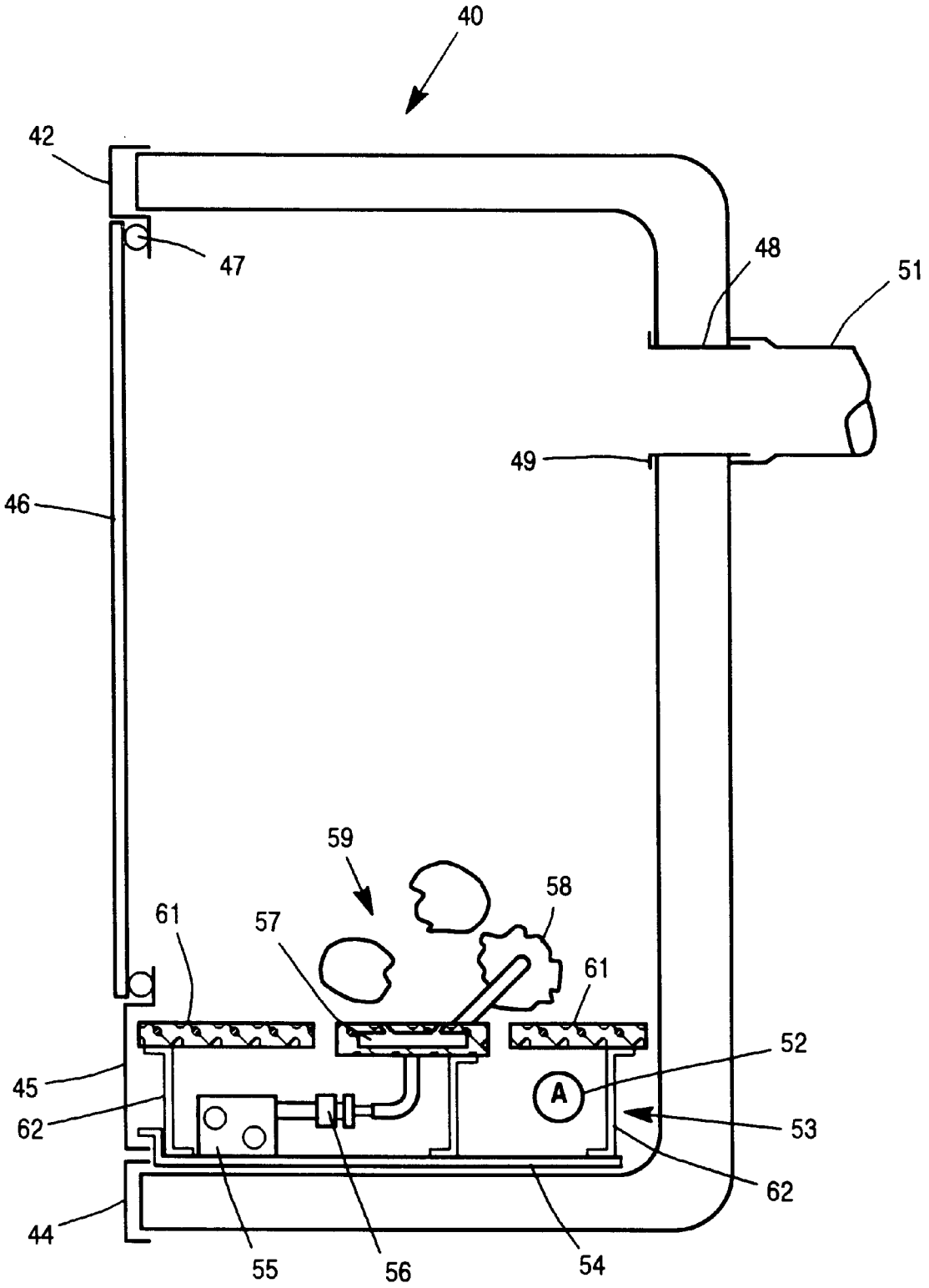
FIG. 3 is a schematic drawing in side elevation of a self purging direct vent fireplace employing the novel open-ended fire box shown in FIG. 2 which may be molded as a single piece.

Refer now to FIG. 3 showing a schematic drawing in side elevation of a self purging direct vent fireplace employing the novel open-ended fire box 40 on which is mounted a surround trim 41 comprising an upper trim piece 42, the lower trim pieces 44 and 45 which provide means for mounting a glass panel 46 which is sealed to the surround trim 41 by a gasket seal 47. The open-ended fire box 40 is shown having a large horizontal aperture in the rear wall designated at numeral 48 for receiving an exhaust collar 49 therethrough which connects to an exhaust pipe 51. Further, there is shown an aperture A at numeral 52 which may be in one of the side walls or the rear wall as will be explained in greater detail hereinafter for supplying combustion air to the burner system 53. The burner system 53 generally comprises a base panel 54 for supporting the elements of the burner. The gas valve 55 is mounted on the pan or panel 54 and is shown having a adjustable shutter valve for supplying gas to a hollow flat pan burner 57 which preferably has a ceramic top that is formed as a bed of coals or burned wood and is shown in detail and described in our U.S. Pat. No. 5,601,073 which issued Feb. 11, 1997. Connected to the flat pan burner and also providing a burner system is a hollow log burner 58. The log system and the burner 58 is preferably supported on the removable floor panel 61 which has cutouts and apertures for fitting over the flat pan burner 57 but offers support for the log system 59. The floor panel 61 is shown supported by support bracket 62. Thus it will be appreciated that the floor panel 61 may be removed to provide access to the burner system 53 which may be removed as a unit. Thus the fireplace which comprises the open-ended box 40, exhaust collar 49 and the glass front 46 may be delivered without the burner system 53 which may be placed inside of the fire box and connected to a source of gas which connects to the gas valve 55. In some embodiments of the present invention, the fresh air aperture 52 is also provided with a collar which has a shutter valve and the outside of the collar connects to an outside air supply which is especially useful for installation in houses that are tightly sealed.

Figure 4:
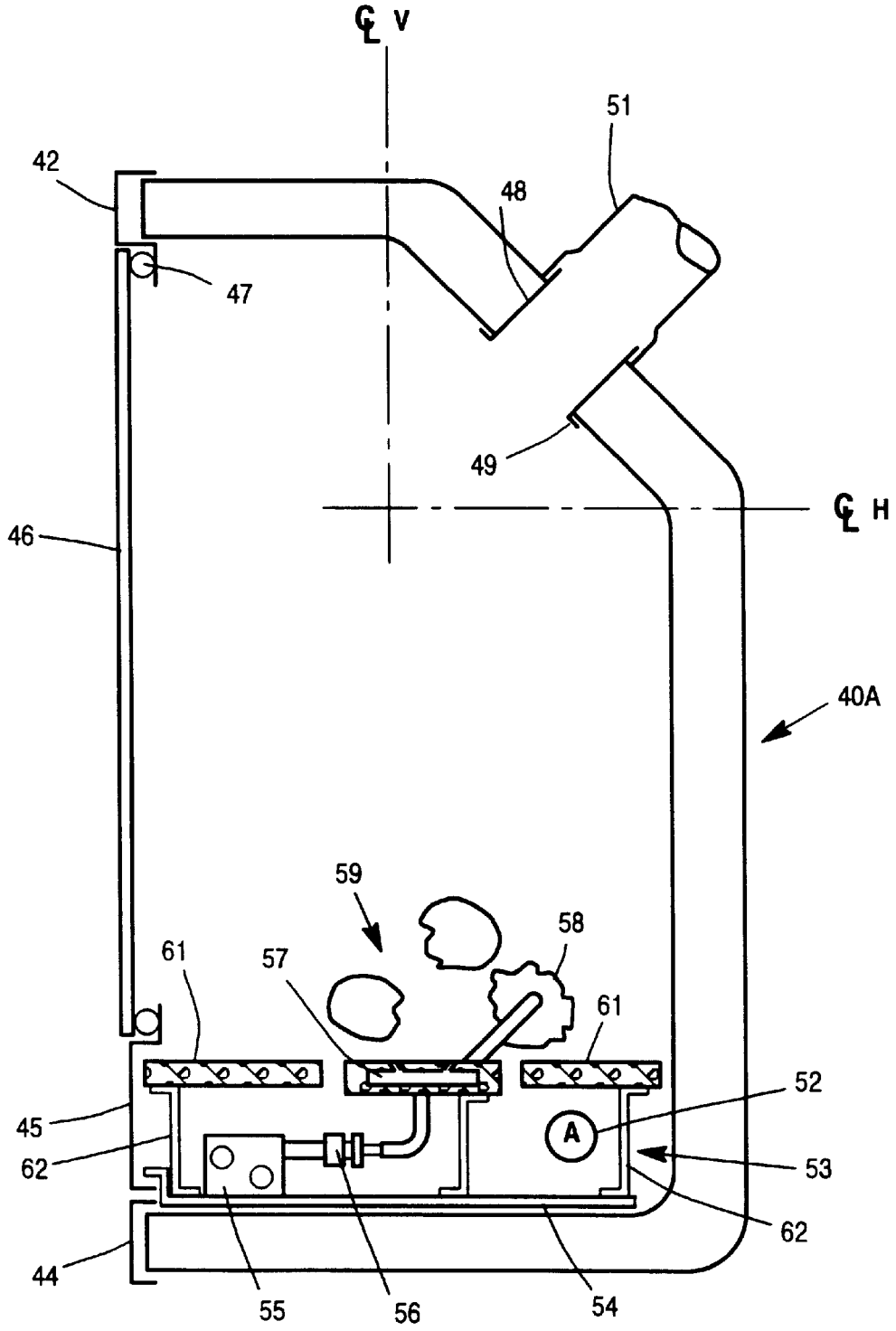
FIG. 4 is a schematic drawing in side elevation of a self purging horizontal/vertical (HV) fireplace employing a modified novel open-ended fire box preferably molded as a single piece.

Refer now to FIG. 4 showing a schematic drawing in side elevation of a horizontal/vertical (H-V) fireplace which has a modified open-ended fire box 40A. It will be appreciated that the rear wall of the fire box is substantially vertical even though the upper portion is diverted horizontally and vertically at a 45° angle so that the exhaust pipe 51 may be replaced by a 45° pipe elbow to provide an exhaust stack which extends either vertically or horizontally. There is also shown on the fire box 40A the center line H where a horizontal stack would be connected, the center line V where a vertical stack would be connected. The burner system and the air supply shown in FIG. 4 is identical to and numbered the same as that shown in FIG. 3 and does not require additional explanation herein. The advantage to the fire box 40A is that it will reduce the amount of inventory required for vertical and horizontal fireplace units.

Figure 5:
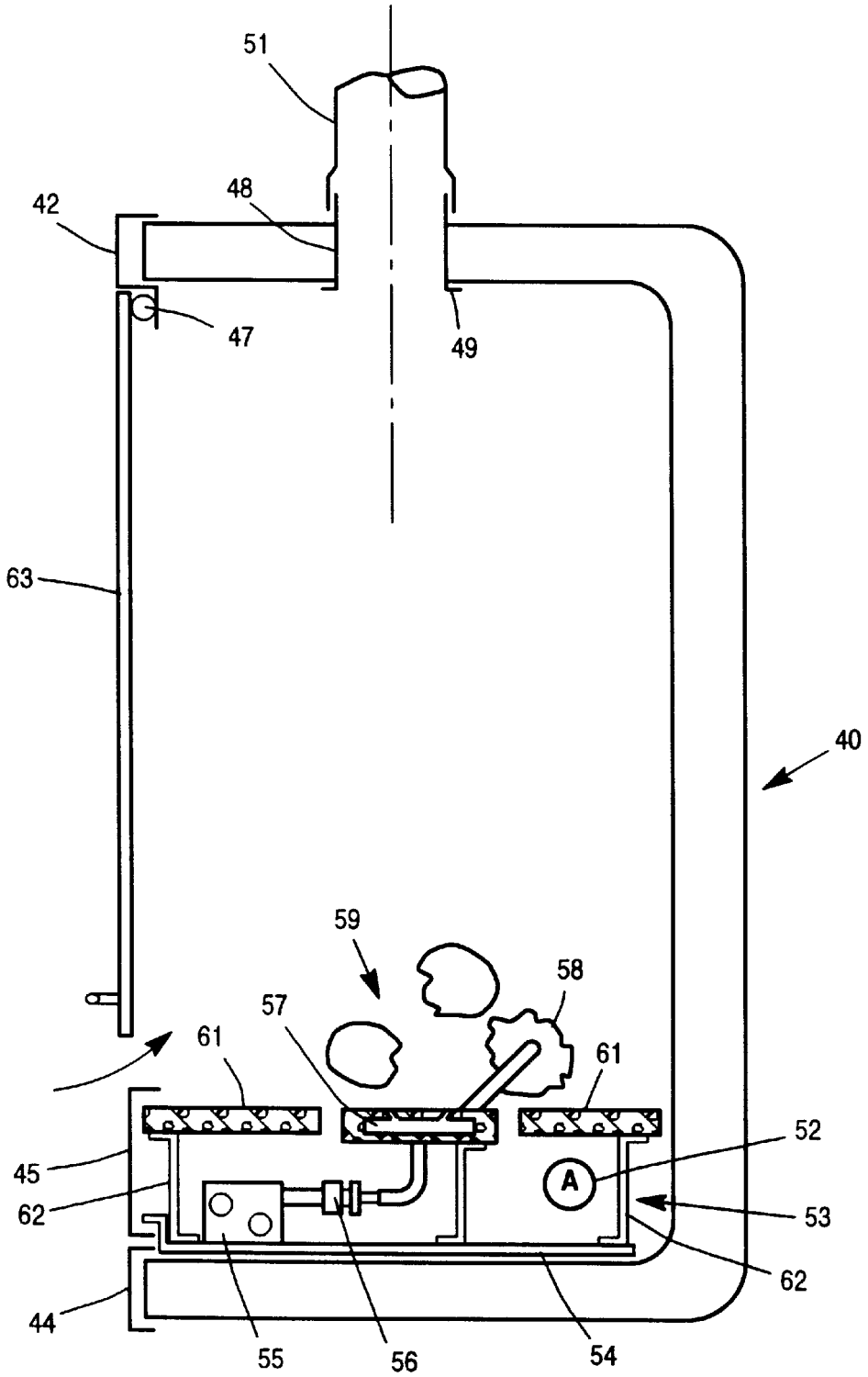
FIG. 5 is a schematic drawing in side elevation of a top vent fireplace employing operable doors mounted on the novel open-ended fire box shown in FIG. 2.

Refer now to FIG. 5 showing a schematic drawing in side elevation of a top vent fireplace employing operable doors 63 mounted on door panel 45 and upper trim piece 42 to provide pivotal points for a pair of operable doors 63. The doors 63 are mounted to provide an air space shown by the arrows which supplies room combustion air into the interior of the fireplace box 40 even though auxiliary air may be supplied by a colinear pipe system to the aperture 52, the same as that shown and described in FIG. 3. All other numerals and elements are the same as those described in FIG. 3 and are numbered the same and do not require additional description herein.

Figure 6:
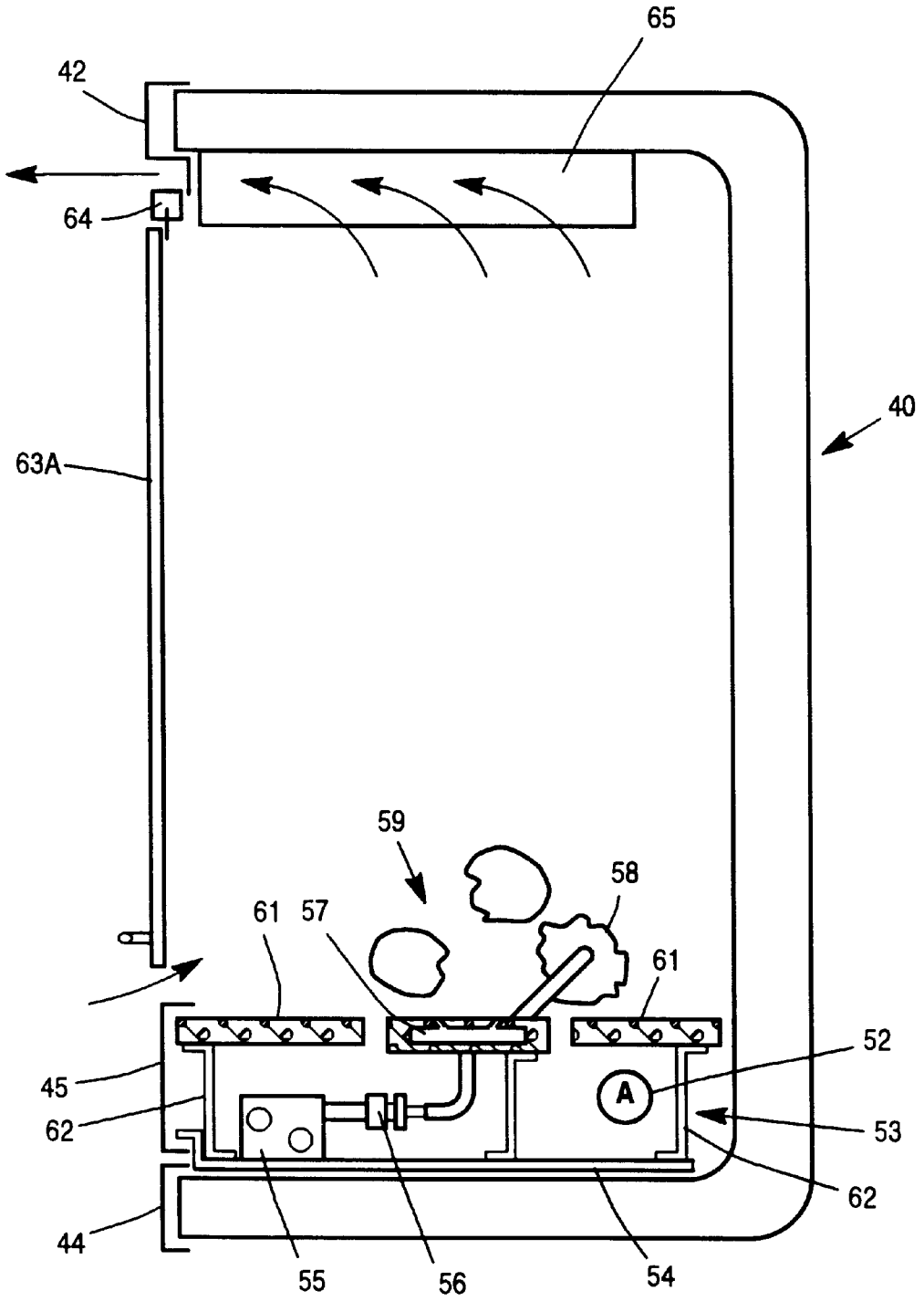
FIG. 6 is a schematic drawing in side elevation of a vent free fireplace which has no exhaust stack that may be used in existing fireplaces or as a stand alone unit.

Refer now to FIG. 6 showing a schematic drawing in side elevation of a vent free fireplace which has no exhaust stack but still uses the base open-ended fireplace box unit 40. Since there is no exhaust stack, all of the combustion air enters under the modified doors 63A as shown by the arrow. The combustion air is burned and contains both CO and $CO_2$. Accordingly, there is provide a catalytic converter unit 65 in the top and hottest portion of the vent free combustion chamber which reduces the CO to $CO_2$, and escapes through the passageway above the door 63A under the trim piece 42. In this embodiment, the modified doors 63A are pivoted the same as that shown and described in FIG. 5 at the bottom but require a side pivot 64 because the door 63A is foreshortened and long pivots would not be desired. The remaining elements in this modified FIG. 6 embodiment are the same as those shown and described in previous drawings and are numbered the same. It will be noted that the fresh air aperture may be connected to an outside fresh air source because the vent free fireplace units are often placed adjacent outside walls where no exhaust stack is provided. Thus, the fresh air aperture may be connected to a source of outside air.

It is estimated that a 30,000 BTU per hour unvented fireplace will produce about two quarts of water per hour. When used in a tightly sealed house there is no alternative to providing a dehumidifier in the attic or a cool space where this moist air collects. Further, when using an unvented fireplace in a tightly sealed house, it is highly recommended that a CO detector be used in the same room with the fireplace even though a catalytic converter is provided for reducing most of the CO.

Figure 7:
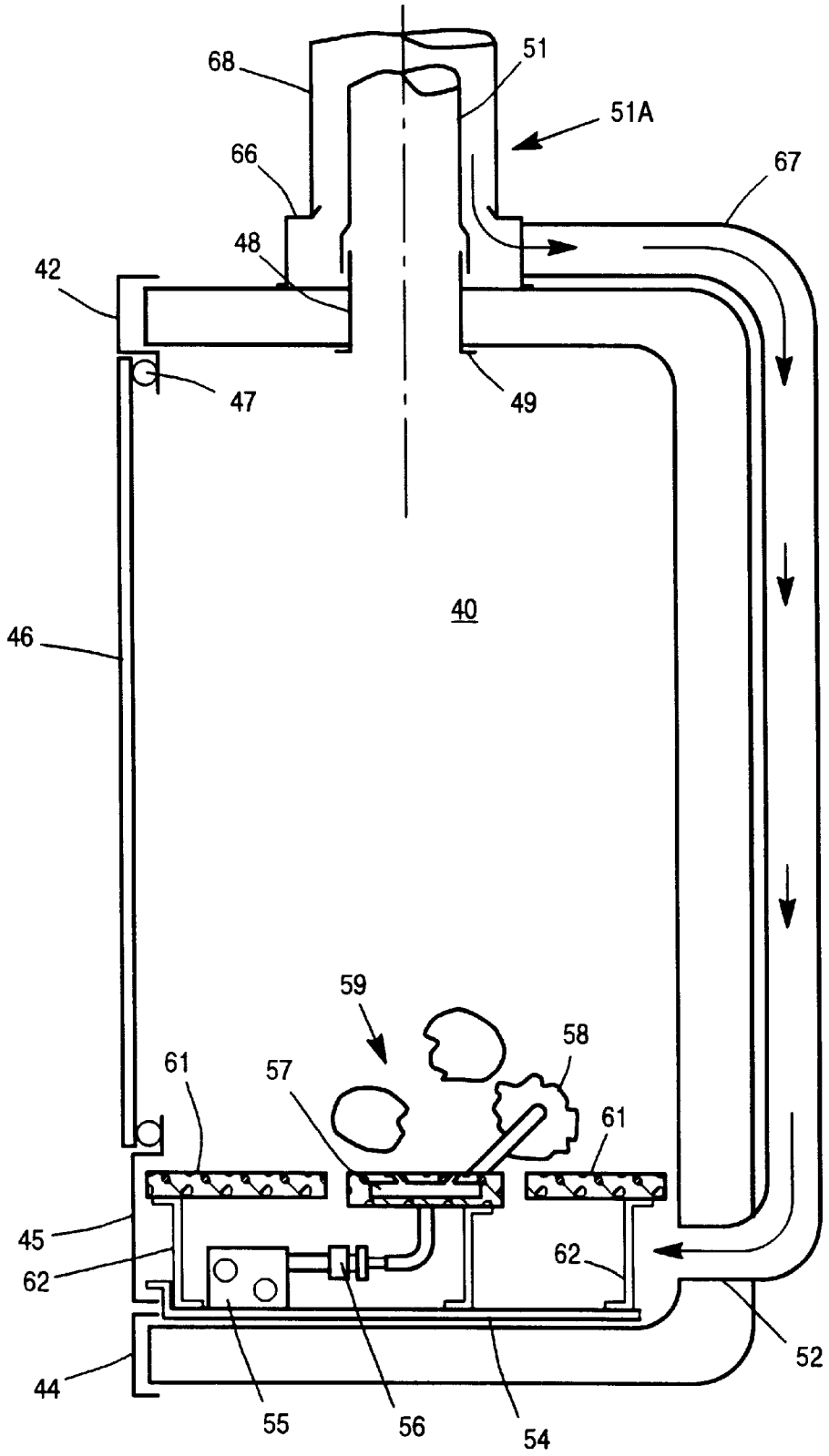
FIG. 7 is a schematic drawing in side elevation of a top direct vent fireplace having a coaxial exhaust stack for supplying outside air to the burner system.

Refer now to FIG. 7 showing a schematic drawing in side elevation of a top direct vent fireplace having a coaxial exhaust stack. Coaxial exhaust stack 51A which has a fresh combustion air plenum 66 that connects to a flexible pipe 67 that supplies fresh air to an aperture 52 in the rear wall of the fire box 40. Thus it will be understood that the outer pipe 68 of the coaxial vent 51A supplies fresh air to the plenum 66 and pipe 67 which dumps the fresh combustion air into the chamber below the floor 61 to provide combustion air for the sealed combustion chamber or open-ended fire box 40.

Figure 8:
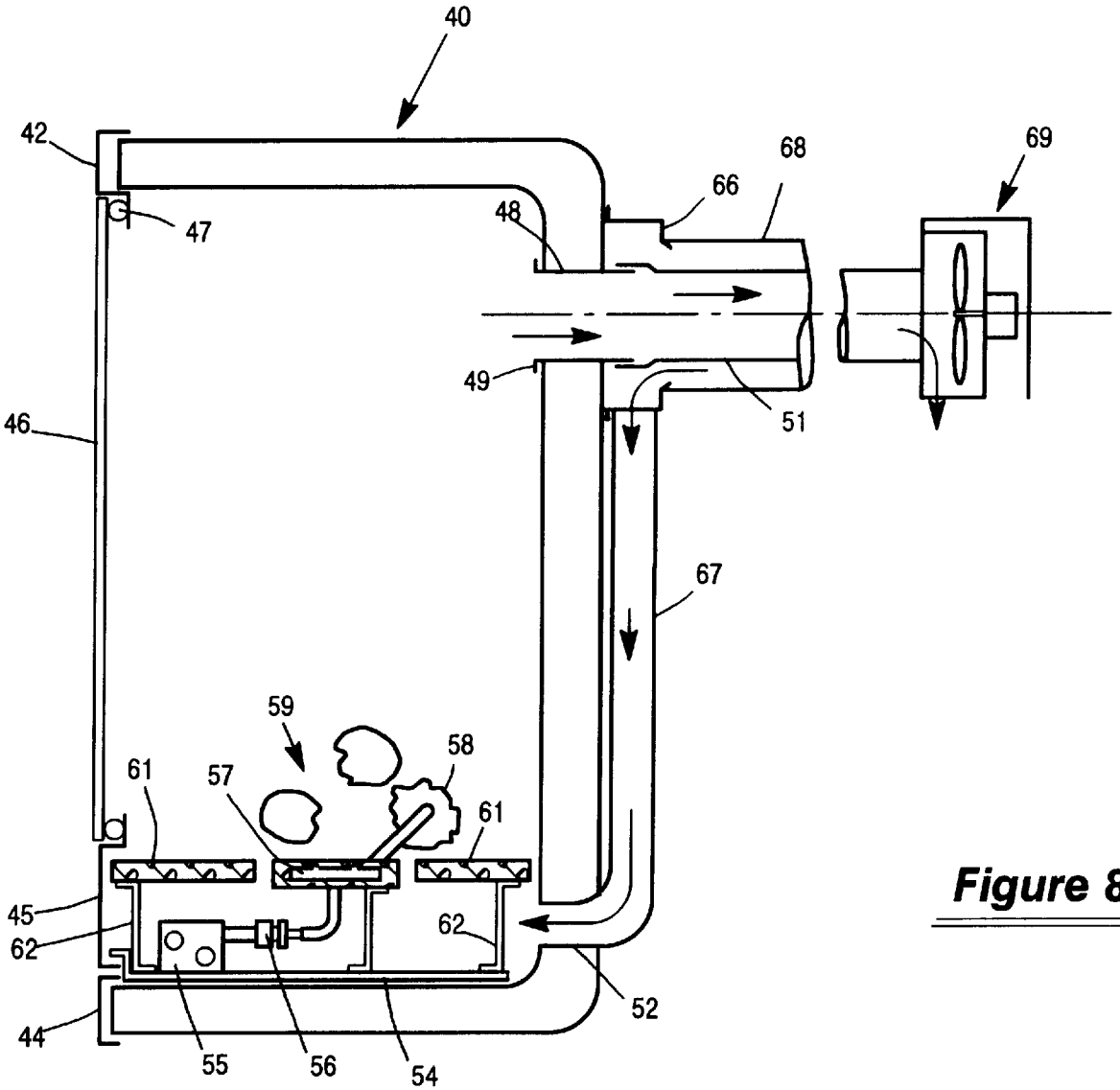
FIG. 8 is a schematic drawing in side elevation of a horizontal direct vent fireplace having a coaxial stack and showing an induced draft fan coupled to the exhaust pipe for long runs.

Refer now to FIG. 8 showing a schematic drawing in side elevation of a horizontal direct vent fireplace having an induced draft fan 69 coupled to the exhaust pipe 51. When a fireplace of the type shown in FIG. 8 requires a long run of the exhaust stack 51, it may be necessary to employ an induced draft fan 69 of the type shown to assure that the combustion chamber is properly purged. While the Underwriter's Laboratory does not have a specification for proper siphoning, manufacturers of gas fireplaces recognize that the problem exist and provide means for assuring that the sealed combustion chamber such as that shown in FIG. 8 and previous Figures is properly purged. The elements of the gas burner system and the sealed glass front and the coaxial exhaust stack are the same as those shown and described in FIG. 7 and previous Figures and employ the same numerals and thus do not require additional explanation herein.

Figure 9:
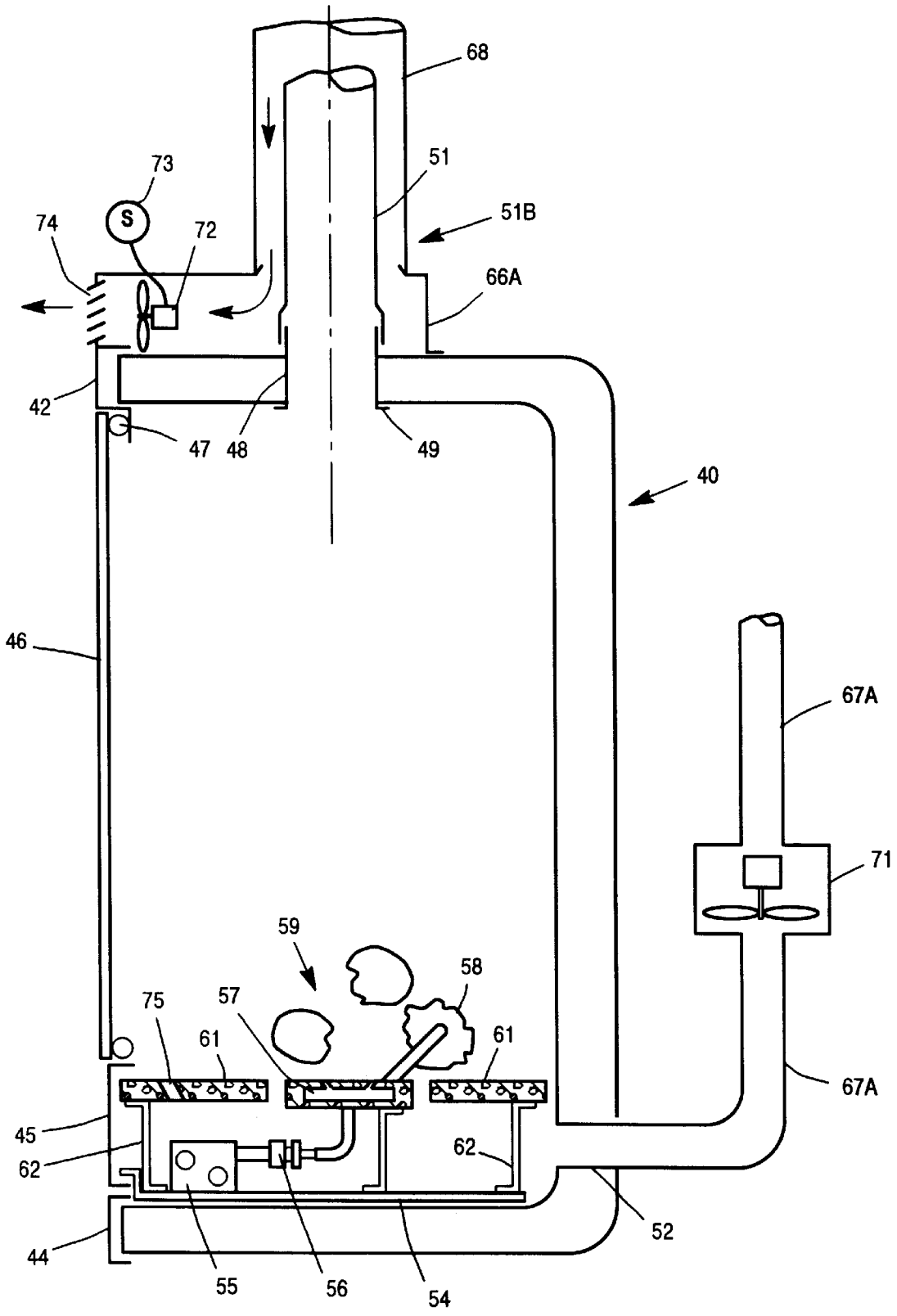
FIG. 9 is a schematic drawing in side elevation of a top direct vent fireplace showing a fan which is connectable in series in the air supply or in the heat exchanger.

Refer now to FIG. 9 showing a schematic drawing in side elevation of a top vent fireplace having a modified coaxial stack 51B which includes a modified heat exchanger plenum 66A. The fireplace of FIG. 9 shows a sealed combustion chamber. Such fireplaces often encounter situations where wind is sufficiently strong at the top exit of the exhaust pipe 51 to produce a positive pressure which is conducted into the combustion chamber of the fire box 40. When this occurs there is insufficient combustion air supplied from the outside. To overcome the pressure differential situation and other situations, an inline fan 71 which operates as an induced draft fan and forces air in pipe 67A connected to an outside source into the aperture 52 in the chamber below the burner system. When the air is forced into the chamber below the burner, there is sufficient pressure in the chamber to provide cooling slots 75 in the floor 61 or in the door panel 45 which is projected vertically upward at the bottom of the glass 46 to provide a cooling effect that will reduce the temperature of the glass panel door 46 up to 200° F. When a forced air fan 71 is employed in any of the previously described sealed combustion chamber units, it is not necessary to employ a high temperature ceramic glass 46, but instead a regular tempered glass 46 may be used which is much less expensive. Thus, it may be desirable to provide the cooling slots 75 in the floor 61 or the door panel 45 in most of the sealed combustion units that have high heat output.

Refer now to the heat exchanger plenum 66A which is mounted on top of the fire box 40 at the hottest portion and further is connected to the coaxial stack 68 which brings fresh air from the outside down along the hot exhaust pipe 51. Thus, the coaxial stack acts as a heat exchanger in conjunction with plenum 66A and the heated outside air may be forced through the grill 74 of the heat exchanger by the induced draft fan 72 which is operable by a switch 73 or a switch thermostat S. Thus, it will be understood that the sealed combustion chamber fireplace shown in FIG. 9 which produces a large amount of radiant heat may also be modified to include a heat exchanger 66A which produces convection heat using the preheated outside air to augment the radiant heat of the fireplace. Further, when the induced draft fan 71 is included, then a sealed combustion chamber unit acts to purge the combustion chamber in the event that pressure differentials could arise.

Figure 10:
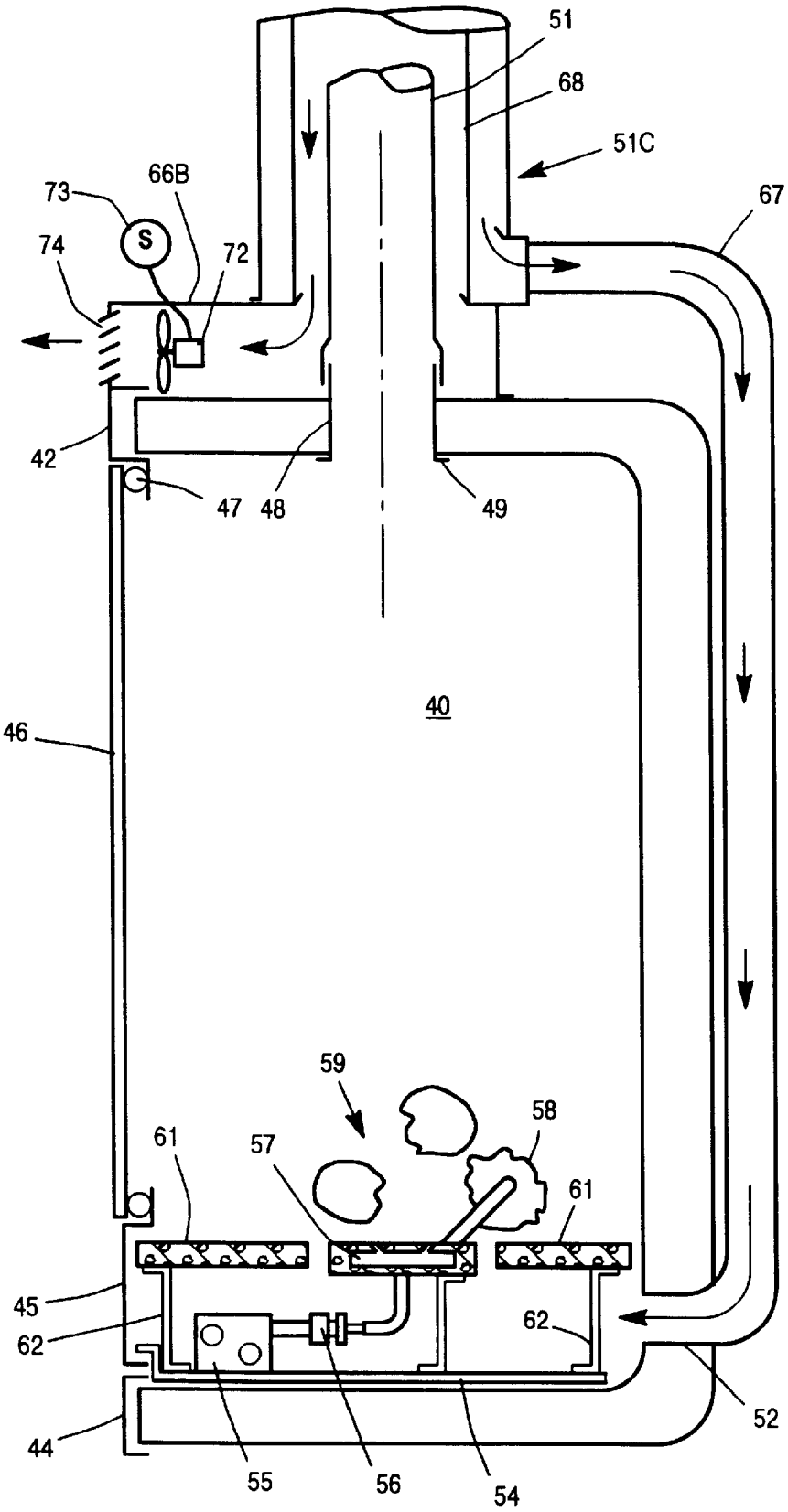
FIG. 10 is a schematic drawing in side elevation of a top direct vent fireplace having a triaxial exhaust for supplying preheated air to a heat exchanger and outside air to the burner system.

Refer now to FIG. 10 showing a schematic drawing in side elevation of a top direct vent fireplace having a triaxial exhaust stack 51C. FIG. 10 is a modified embodiment of the previously described heat exchange system shown in FIG. 9. The heat exchanger in FIG. 10 is designated 66B and connects to the passageway between the pipes 51 and 68 so as to provide preheated outside air to the heat exchanger 66B which is forced by the induced draft fan motor 72 through the grill 74. If there is no wind shear or pressure differential problem, the outside air for combustion may be supplied through a separate triaxial stack 76 which connects to the previously described flexible fresh air pipe 67 which connects to the aperture 52. All other numerals in FIG. 10 are the same as those used in previous Figures for elements and components which are described herein before and do not require additional explanation. Further, it should be understood that the flexible fresh air pipe 67 may be replaced by the fresh air pipe 67A which includes therein the inline induced draft fan 71 in the embodiment shown in FIG. 10. Further, it should be understood that the induced draft fan 71 may be included in any of the previous clearly described embodiments where a fresh air aperture 52 is provided. When the induced draft fan 71 is employed, it always operates automatically when the burner is turned on. In contrast thereto, the induced draft fan 72 may be operated by a remote switch or a thermostat switch 73.

Figure 11:
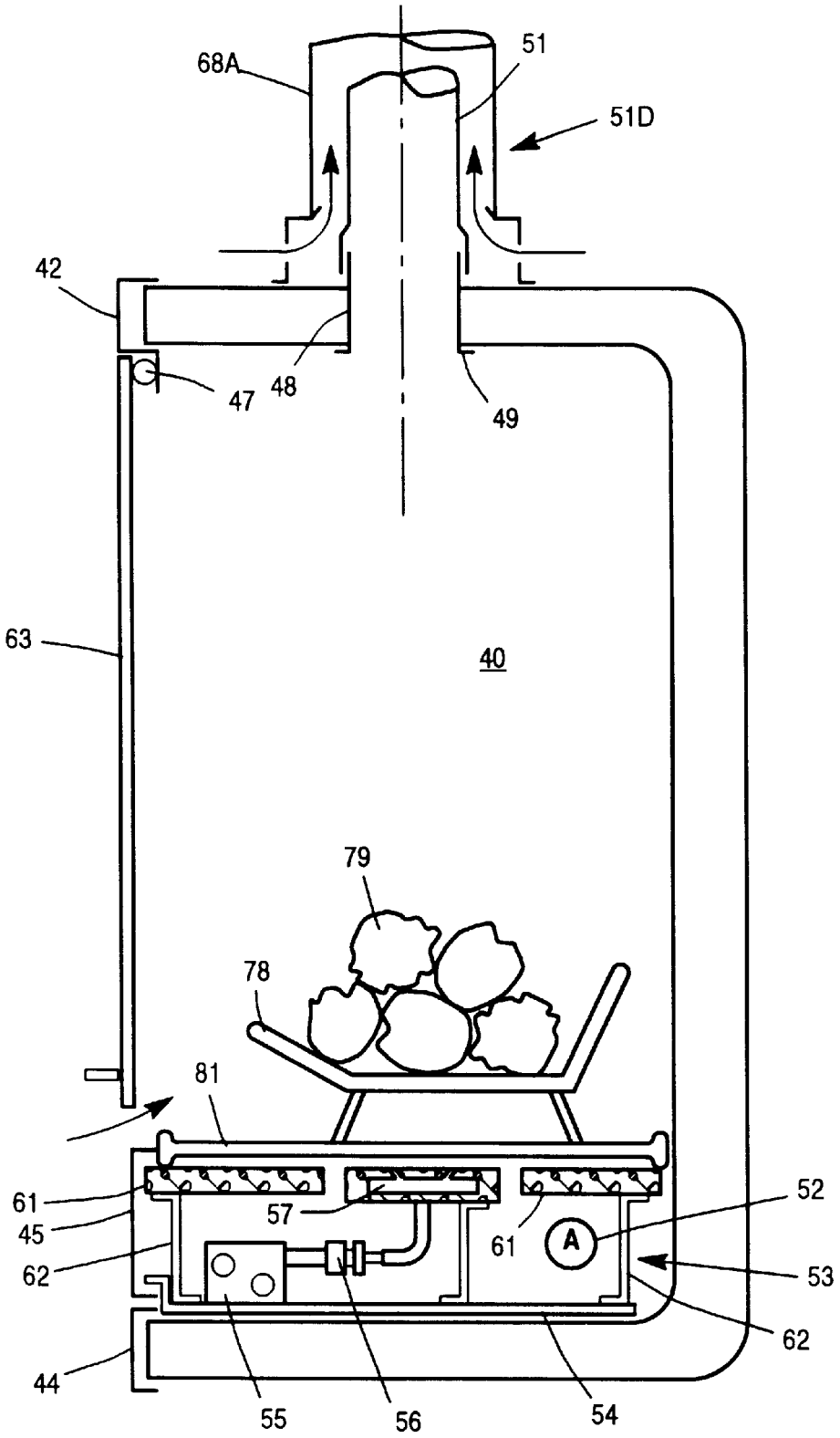
FIG. 11 is a schematic drawing in side elevation of a top vent fireplace which is convertible from wood to gas and convertible back to wood without the need for special tools.

Refer now to FIG. 11 showing a schematic drawing in side elevation of a top vent fireplace which uses an open-ended fire box 40 to provide a wood burning fireplace which is convertible to a gas fireplace and convertible back to a wood fireplace without the need for special tools. In this embodiment, since a wood burning fireplace is desired, a class A chimney is mandatory and is shown at stack 51D. The stack 51D includes and inner pipe 51 and an outer pipe 68A which connects to a vent collar 77 of the conventional type which induces room air in the space between 51 and 68A to cool the stack. For purposes of illustration, there is shown a grate 78 holding a supply of wood 79 to be burned. The grate is supported by a wood burning floor panel 81 which completely seals off the floor area from the gas burner system of the type previously described in FIG. 3 and other Figures. When it is desired to convert to gas, it is only necessary to remove the wood 79, the grate 78 and the wood burning floor panel 81 leaving the gas burner system exposed for use. It may be desirable to install the wood burning fireplace shown in FIG. 11 in new homes without supplying the burner system below the wood burning floor panel 81. In this event, a standoff platform is substituted for the gas burner system which may be installed at some later date. This feature enables a low installation cost for initial use or installation in areas where gas lines have yet to be connected. In the preferred embodiment of the present invention, if the gas burner system shown is not installed, it is desirable to at least install the connector pipe for the connection of gas so that the fireplace box 40 if sealed in an enclosure does not have to be removed for subsequent connection of the gas burner system. Further, it will be appreciated that the fresh air aperture may be connected to a source of outside air in colder climates where such configurations are desirable and this is also used in the wood burning system as well as the to be installed or future gas system.

Having explained a preferred embodiment open-ended fire box 40 and a modification 40A thereof, it will be understood that the fire boxes 40 are made in three or four standard sizes and may be finished in the factory to the point where they are ready for installation in new homes or retrofitted into existing homes. Since the burner system is removable from the fire box by lifting it out, it is not necessary to make adjustments or do maintenance in an inaccessible area. Thus, in the preferred embodiments shown it is recommended that quick snap connectors be employed for the gas lines which connect to the burner system so that the system may be rapidly disconnected and removed without any special tools.

Having explained numerous different types of fireplaces, it will now be appreciated that those fireplaces which have sealed glass panels or doors 46 do not ordinarily provide convection heat but provide a substantial amount of radiant heat. The differential between radiant heat and convection heat may be as much as 25 to 40 percent. Thus, when the additional heating effect of a fireplace is desired, the heat exchanger may be employed. However, as an alternative when operable doors 63 or 63A are employed with the novel fireplace units, the doors may be cracked open or fully open and the amount of convection heat that is produced with open doors is substantially the same as that was previously produced with the metal fireplaces shown in the prior art fireplace FIG. 1. It was originally believed that the insulating fire box would result in the loss of heat from the fireplace unit. However, experience has shown that using an insulating fire box does not necessarily require that any heat loss or inefficiency result when compared to the sheet metal fireplaces of the prior art. When the present all reinforced ceramic fire box chamber is employed, the cost of the external shroud which is used to provide a heat exchanger is completely eliminated. If a heat exchanger is desired, it may be provided without additional cost when a coaxial stack is ordinarily used. The only additional cost is the plenum that is used to house the heat exchanger motor.

Having explained the universal open-ended fire box, it will now be appreciated that substantial manufacturing costs over sheet metal fireplaces has been achieved without any degradation of the heat effect of a fireplace unit while enhancing the appearance of the fire box to the point where it is indistinguishable from custom masonry fireplaces.

What is claimed is:

1. A low cost decorative prefabricated fireplace without a housing for installation inside individual room spaces to be heated, comprising:

a non-porous one piece open fireplace box, said fireplace box comprising a high temperature fiber insulating material comprising a reinforced ceramic fiber (RCF) and a non-organic binder, said fireplace box having at least five walls of interconnected homogenous said (RCF) material and a binder, said fireplace box having a top wall, a bottom wall, a rear wall and side walls, a removable floor panel mounted inside said fireplace box and spaced apart from said bottom wall forming an air chamber for combustion air below said floor panel and a combustion space above, a decorative log set mounted above said floor panel, burner means comprising a burner mounted below said log set at said floor panel, tubular exhaust stack means mounted on and extending through an aperture in one said fireplace box wall and coupled to the combustion space in the fireplace box, and decorative surround trim means mounted on the exposed edges of the fireplace walls which form said open fireplace box for providing a prefabricated fireplace without the need for separate outer housings.

2. A prefabricated fireplace as set forth in claim 1 wherein said fireplace box walls each comprise a thick high temperature rigid insulating material greater than 1" in thickness to about 2" in thickness.

3. A prefabricated fireplace as set forth in claim 2 wherein said thick rigid insulating wall thickness is at least sufficient to reduce the combustion temperature encountered in the combustion space to about 90° Fahrenheit plus ambient at the outside surface of said walls sufficient to eliminate the need for an outer housing.

4. A prefabricated fireplace as set forth in claim 1 wherein said air chamber below the floor panel is provided with an opening coupled to an outside source of combustion air.

5. A prefabricated fireplace as set forth in claim 4 wherein said opening comprises an aperture through a side wall or rear wall of the fireplace box coupled to an outside source of combustion air.

6. A prefabricated fireplace as set forth in claim 1 wherein an opening for combustion air is provided in the surround trim open end of said open fireplace box.

7. A prefabricated fireplace as set forth in claim 5 wherein said aperture is coupled to an air passageway which connects to a coaxial exhaust stack source of outside air.

8. A prefabricated fireplace as set forth in claim 5 wherein said aperture is coupled to a colinear air passageway source of outside air.

9. A prefabricated fireplace as set forth in claim 1 wherein said burner means comprises a pan type burner at the floor level and a hollow log burner at a higher level.

10. A prefabricated fireplace as set forth in claim 1 where in said burner means comprises a pan type burner having a three dimensional surface in the form of a glowing bed of wood, and a gas mixing valve coupled to said pan type burner in said air chamber.

11. A prefabricated fireplace as set forth in claim 10 which further includes a gas valve in said air chamber coupled to said mixing valve, and means for accessing said gas valve through said surround trim.

12. A prefabricated fireplace as set forth in claim 1 wherein said exhaust stack means comprising a plurality of coaxial pipes having a hot exhaust gas pipe surrounded by a larger pipe coupled to a source of outside air for preheating the source of outside air and cooling the exhaust pipe, and a heat exchanger means connected to said larger pipe and to an outlet for supplying preheated air to a room or space to be heated by convection air.

13. A preheated fireplace as set forth in claim 1 which further includes axial flow fan means for increasing the flow of outside or room air, and switch means for controlling said axial flow fan means.

14. A low cost decorative prefabricated fireplace for installation in individual room spaces to be heated, comprising:

a one piece open-ended fireplace box having an interior surface molded to a pattern duplicating a desirable fireplace texture, said fireplace box having at least five walls of homogenous interconnected inorganic ceramic material, said fireplace box material consisting primarily of reinforced ceramic fiber (RCF) material and inorganic binder, first removable floor means mounted inside said fireplace box above the bottom wall of the fireplace box, gas burner means mounted in said fireplace box below and at said first removable floor means, removable log set means mounted in said fireplace box above said first removable floor means, and decorative surround trim means mounted on the open end of said fireplace box for providing a low cost prefabricated fireplace.

15. A fireplace as set forth in claim 14 which further includes second removable floor means mounted on top of said first removable floor means, and said removable log set means comprises gas logs when burning gas and organic burnable logs when said second removable floor is installed on top of said first removable floor.

16. A method of making a low cost decorative prefabricated fireplace without a housing for installation inside individual room spaces to be heated, comprising the step of:

vacuum forming a one piece lightweight open fireplace box consisting essentially of reinforced ceramic fibers (RCF) and a non-organic binder, curing said open fireplace box to provide at least three interconnected side walls, a top wall, a bottom wall, and an open side wall, mounting removable floor means in said fireplace box spaced apart from said bottom wall forming a combustion air chamber below and a combustion space above said removable floor, mounting gas burner means under and through said removable floor means, and mounting a prefabricated decorative surround trim on the open side wall to provide a gas fireplace usable inside of a room to be heated.

17. A method as set forth in claim 16 which further includes the step of coupling a tubular exhaust stack through a top wall or a side wall into said combustion space.

18. A method as set forth in claim 16 which further includes the step of coupling a heat exchanger to said tubular exhaust stack outside of said fireplace box.

19. A method as set forth in claim 16 which further includes the step of coupling a source of outside air into the air chamber below said removable floor.

* * * * *